United States Patent [19]

Buchmeier et al.

[11] Patent Number: 4,877,495

[45] Date of Patent: Oct. 31, 1989

[54] ELECTROLYTIC COLORING OF ANODIZED ALUMINUM

[75] Inventors: Willi Buchmeier; Dieter Brodalla, both of Duesseldorf, Fed. Rep. of Germany

[73] Assignee: Henkel Kommanditgesellschaft auf Aktien, Duesseldorf, Fed. Rep. of Germany

[21] Appl. No.: 306,287

[22] Filed: Feb. 2, 1989

Related U.S. Application Data

[63] Continuation of Ser. No. 202,761, Jun. 3, 1988, abandoned.

[30] Foreign Application Priority Data

Jun. 5, 1987 [DE] Fed. Rep. of Germany ..... 3718849

[51] Int. Cl.[4] ..... C25D 11/22

[52] U.S. Cl. ..... 204/42; 204/58

[58] Field of Search ..... 204/42, 37.6, 58, DIG. 9

[56] References Cited

U.S. PATENT DOCUMENTS 4,042,468 8/1977 Hasegawa et al. ..... 204/42
4,401,525 8/1983 Ruf ..... 204/42

FOREIGN PATENT DOCUMENTS 3248472 2/1984 Fed. Rep. of Germany .
359495 10/1931 United Kingdom .

OTHER PUBLICATIONS

V. F. Henley, Light Metals, pp. 536–541, Oct. 1949.
Helmer Bengston, Plating, pp. 918–921, Jul. 1956.
Die Oberflaechenbehandlung v. Aluminum (1977), pp. 354–374 and pp. 309–312.
Metalloberflaeche, 32 (1978), pp. 450–454.

*Primary Examiner*—G. L. Kaplan
*Attorney, Agent, or Firm*—Ernest G. Szoke; Wayne C. Jaeschke; Norvell E. Wisdom

[57] ABSTRACT

A process for the electrolytic coloring of anodized surfaces of aluminum or aluminum alloys using alternating current or direct current superimposed on alternating current, the electrolytic coloring being carried out with an electrolyte which contains cationic organic dyes and, optionally, conducting salts.

32 Claims, No Drawings

ELECTROLYTIC COLORING OF ANODIZED ALUMINUM

This application is a continuation of application Ser. No. 07/202,761 filed June 3, 1988 and now abandoned.

BACKGROUND OF THE INVENTION

1. Field of the Invention

This invention relates to a process for the electrolytic coloring of anodized surfaces of aluminum or aluminum alloys using alternating current or direct current superimposed on alternating current, the electrolytic coloring being carried out with an electrolyte containing cationic organic dyes.

2. Statement of Related Art

To increase resistance to corrosion and to obtain decorative effects, the surface of aluminum and its alloys may be substantially modified by mechanical techniques or may be provided with metallic or non-metallic coatings. Reinforcement of the natural protective oxide film by chemical or electrical techniques has acquired considerable significance.

In the prior art, processes for coloring surfaces of aluminum or aluminum alloys comprise adsorptive coloring, color anodizing and electrolytic coloring, see Wernick, Pinner, Zurbruegg, Weiner "Die Oberflaechenbehandlung von Aluminium (The Surface Treatment of Aluminum)", Leuze Verlag, (pub.) Saulgau, Wuertt (1977), pages 354 to 374 and 309 to 312.

In adsorptive coloring, for example, an organic dye is introduced into the pore openings of the oxide layer, remaining adsorbed in the surface region of the surface. Adsorptive coloring enables the entire color spectrum to be obtained with a high degree of uniformity and reproducibility. The various dyes useable in this process are commercially obtainable.

In addition, color anodizing (integral method) has been in use for years. In a substrate colored by the integral method, the finely divided inorganic dye particles are not situated in the pores of the oxide layer, but remain behind as an alloying constituent in the aluminum oxide layer. In the integral process, special aluminum alloys are both electrolytically oxidized and also colored in a single process step, generally using d.c. voltages of up to 150 V. The electrolyte used consists of a suitable organic acid, for example maleic, oxalic, sulfosalicylic, or sulfophthalic. However, the integral process is being used increasingly less in practice for reasons of cost (high current consumption, expensive cooling systems).

By contrast, in electrolytic coloring using metal salt solutions, a colorless transparent oxide layer is produced in a first process step by anodic oxidation using direct current in aqueous sulfuric acid and/or other electrolyte solutions. In a second process step, it is colored (in contrast to adsorptive coloring) by deposition of metal particles on the bottom of the pores in the oxide layer from metal salt solutions using alternating current. The colors range from light bronze through dark bronze to black. Completely light-stable color finishes are obtained because the coloring metal particles are incorporated on the bottom of the pores (W. Sautter, Metalloberflaeche, 32, 1978, pages 450 to 454).

By virtue of their advantages, such as relatively high light stability and weather resistance, electrolytic coloring processes are largely used for coloring aluminum which is to be used in the architectural field. Electrolytic coloring processes are dominated by electrolytic metal salt coloring by virtue of its relatively low costs and, thus, greater economy compared with integral coloring, Sn(II)-, Co-, Ni- and Cu-containing electrolyte solutions preferably being used in electrolytic metal salt coloring.

U.S. Pat. 4,401,525 (and corresponding published German application No. 28 50 136) describe a process for the electrolytic metal salt coloring of aluminum in which a defined oxide layer is first produced by direct current in acidic solution and subsequently colored using alternating current and an acidic electrolyte containing tin(II) salts, the electrolyte also containing stabilizers for the tin(II) salts. However, coloring electrolytes containing metal salts such as these are unsuitable for producing brightness and lightness of any degree on the surfaces of aluminum and aluminum alloys.

Published German patent application No. 32 48 472 describes a process for coloring anodically produced oxide coatings on aluminum and aluminum alloys which uses a coloring electrolyte with which it is possible to obtain colors of different brightness and lightness ranging from gray through bronze to violet-blue, more especially for use in profiles for windows, doors, facade panels and the like, on anodized aluminum surfaces. To enable color finishes such as these to be economically and reproducibly obtained in the same color at any time, even where different shades are involved, the coloring electrolyte contains an organic dye component in addition to a metal salt. An azo dye containing metal complexes is proposed as the organic dye component. Thus, published German application No. 32 48 472 describes a process for coloring anodically produced oxide coatings in an electrolyte containing metal salts with simultaneous adsorptive coloring using an azo dye containing metal complexes.

None of the coloring processes described above are entirely satisfactory in terms of practical application. Electrolytic coloring processes (including both the integral process and also metal salt coloring) do not produce bright colors, but only gray or bronze to black. Although a wide range of bright colors can be obtained by adsorptive coloring, the dyes used are only adsorbed in the upper region of the pores. Accordingly, the color finishes are not abrasion-resistant. Under mechanical stressing, the surface is attacked, i.e. the dyes are worn away so that the color is lost. Since stressing of the type in question is locally irregular, the resulting scratches, marks, discoloration and the like are particularly noticeable. Accordingly, the usefulness of aluminum parts colored in this way is seriously affected. Surface coloring of the type in question is also unsuitable for aluminum facade panels because their subsequent cleaning with preparations normally containing abrasives also results in fading.

SUMMARY OF THE INVENTION

The present invention provides an improved process for the electrolytic coloring of anodic surfaces of aluminum or aluminum alloys using alternating current or direct current superimposed on alternating current which is not attended by any of the above disadvantages. This invention also includes the products of the process, which products may be considered physically unique because of both the nature of the embedded dyes and their positioning within the aluminum oxide pores.

This is achieved by carrying out the electrolytic coloring using an electrolyte containing cationic organic dyes.

Thus, the present invention provides a process for the electrolytic coloring of anodized surfaces of aluminum or aluminum alloys using alternating current or direct current superimposed on alternating current, the electrolytic coloring being carried out with an aqueous electrolyte which contains cationic organic dyes and, optionally, conducting salts.

The advantage of the inventive electrolytic coloring process over adsorptive coloring processes lies in the fact that, in the inventive process, the cationic organic dyes advance to the bottom of the pores in the oxide coating, which affords the dyes better protection against abrasion and corrosion. By virtue of this deep deposition at the bottom of the pores, it is possible economically to produce highly abrasion-resistant bright colors on anodized aluminum.

Previously, it has only been possible by the known method of electroadsorptive coloring using organic dyers to produce "nonbright" colors, such as gray tones, on anodized aluminum. By contrast, the inventive process makes it possible to obtain a wide variety of colors characterized by a high depth of penetration.

DETAILED DESCRIPTION OF THE INVENTION

Other than in the operating examples, or where otherwise indicated, all numbers expressing quantities of ingredients or reaction conditions used herein are to be understood as modified in all instances by the term "about".

In principle, any cationic organic dyes may be used in the inventive process. Examples of such types of dyes are triphenylmethane, cyanine, xanthine (xanthene dyes of the rhodamine group), acridine, azine, thiazine or pyrylium. Of these dyes, those of the triphenylmethane, xanthene and azine type are particularly preferred. Examples of representatives of these preferred groups of cationic dyes include crystal violet, malachite green, methyl violet, rhodamine 6G, and methylene blue. Dyes such as these may be used both individually and in the form of mixtures, to achieve differing color effects.

By virtue of their positive charge, the cationic organic dyes are deposited on the bottom of the pores during the negative half wave of alternating current, when it is employed.

In general, the cationic organic dyes may contain all possible anions providing they do not have an adverse effect on the electrolytic deposition of the cationic organic dyes. In this connection, it is of course important to ensure when choosing the anion that the dye salt should be soluble in water. In principle, suitable anions for the dye cations are the anions of mineral and carboxylic acids, for example chloride, sulfate, perchlorate, acetate, tetrafluoroborate or oxalate. Preferred anions for the inventive cationic organic dyes are chlorides, perchlorates and/or oxalates. Dye salts such as these are commercially available in some cases or may be produced by known methods.

The inventive process is conducted using voltage and current density ranges typically employed in the prior art, for electrolytic metal salt coloring. In general, the process according to the invention is carried out at 8 to 30 volts (preferably 10 to 22 volts), depending on the electrode spacing, and at known corresponding current densities. The frequency of the alternating current is normally 50 Hz (in Europe, and elsewhere) to 60 Hz (in the U.S.). Where alternating current of a different frequency (Hz) is used, the voltage range should be proportionally adjusted, using calculations well known in the art, for example, a slightly lower voltage range may be used with a higher frequency. The material used for the counter electrode is normally fine steel, although other materials, for example graphite, may also be used.

Where reference is made in connection with the inventive process to direct current superimposed on or by alternating current, this is understood to be an asymmetrical alternating current of which the amplitude levels of the positive and negative half waves have different values. Corresponding circuit arrangements for producing such direct current superimposed on alternating current are known in the art.

Electrolytic coloring according to the invention is carried out in aqueous solution. Accordingly, the upper limit to the concentration of the cationic dye in the aqueous electrolyte solution is imposed by the upper solubility limit of the particular dye in water. So far as the lower concentration limit of the dye is concerned, it is important to bear in mind that an inadequate concentration of the dye in the electrolyte will prevent economic working of the process according to the invention. According to the invention, therefore, the concentration of the cationic dyes in the electrolyte solution is in the range from 0.01 g/l to the upper solubility limit of the particular dye, preferably 0.01 to 10 g/l, most preferably 0.05 to 5.0 g/l.

In addition to the cationic organic dyes, the electrolyte solutions used in the inventive process may contain conducting salts to increase the conductivity of the solutions. Corresponding conducting salts are known from the relevant prior art and may be at least one: water-soluble alkali metal, ammonium or alkaline earth metal salt of any acid which comprises the anion of the inventive cationic dyes. Preferably a sulfate, and most preferably sodium sulfate and/or magnesium sulfate, are used as conducting salts in the inventive process. The concentration of the conducting salts in the inventive aqueous electrolyte solutions is generally 1 to 50 g/l, preferably 5.0 to 20.0 g/l. An addition of the above conducting salts can intensify the color finish obtained in each individual case. Accordingly, it can be decided in each individual case, (i.e. depending on the dye used and on the type and intensity of the desired color finish), whether such an addition is desirable.

Other, similarly non-critical influencing factors in the inventive process are the pH and the temperature of the electrolyte solution, as well as the residence time of the material to be colored. As far as the pH of the electrolyte solution is concerned, it may be regarded as a general rule that the pH established on dissolution of the particular dye in the aqueous electrolyte solution (and in the indicated concentration range) is the optimal pH for that dye. The inventive process may also be carried out at different pH values of the electrolyte solution. Thus, the pH of the electrolyte solutions is generally 1 to 9 and—in the light of the foregoing observations—preferably acid to neutral, most preferably 2 to 5. However, if the pH of the aqueous electrolyte solution is to be adjusted, the acids or alkalis used should not adversely affect the electrolytic deposition of the cationic dyes. For example, dilute aqueous sulfuric acid or sodium hydroxide may be used for pH adjustment.

As far as the temperature of the electrolyte solution is concerned, the process is preferably carried out at ambient temperature, i.e. at a temperature in the range from about 15 to 25° C., solely for the saving of energy which this involves. However, in individual cases, (again in dependence upon the dye selected), it may be advisable to work at higher temperatures, for example from 15° C. up to about 60° C., to support the diffusion of the dye molecules and thus to obtain more uniform coloring., The residence time of the material to be colored in the electrolyte solution depends primarily on the required depth of color of the color finish, such depth being time dependent. It is not possible to provide any generally applicable, definitive guidelines for the residence time, instead the optimal residence time is easily determined by trial and error from case to case. Times of 10 to 90 minutes are contemplated, however, residence times of about 15 to 30 minutes are typical.

The last parameters discussed above, namely temperature and residence time, are used in particular to optimize the desired coloring and may easily be determined in each individual case by a few orienting preliminary tests.

In one preferred embodiment of the inventive process the substrates to be colored, i.e. anodized workpieces of aluminum or aluminum alloys, are first treated with direct current in the same electrolyte before the actual coloring treatment using either alternating current or direct current superimposed on alternating current. To this end, the workpiece is electrically connected to serve as the anode. The voltage of the direct current during this treatment is in the same above-mentioned range. As far as the other parameters are concerned, the foregoing observations similarly apply. The actual coloring process does not take place during this pretreatment which, instead, provides for greater uniformity of the subsequent coloring and for better depth scattering thereof. Further information on this pretreatment with direct current can be found in previously mentioned U.S. Pat. 4,042,468, which is incorporated herein by reference.

Through the application of several successive treatments by the inventive process, the aluminum oxide coatings can be colored a variety of shades by measured coordination of the influencing factors of the individual treatments. Thus, such successive treatments comprise a part of this invention.

Before the electrolytic coloring of the anodized surfaces in accordance with the invention, the articles made of aluminum or aluminum alloys are subjected to a typical predetermined to produce the oxidic surface coating. In this pretreatment stage, the condition of the semifinished products to be anodized, i.e. the shine or dullness of the surfaces and also the composition of the electrolyte and the working conditions during the anodizing process, are important influencing factors. The conditions known from the relevant prior art, for example mentioned in the article by Wernick, et al., supra, are here applicable.

The following examples are intended to illustrate the invention although the invention is by no means confined to the particulars disclosed in the examples.

EXAMPLES

Pretreatment:

Test plates (measuring 50 mm × 40 mm × 1 mm) of the material Al 99.5 (DIN - Germany Industry Norm material no. 3.0255) were used for the following Examples.

Before anodizing, the plates were degreased, pickled and descaled by standard methods. Degreasing was carried out with an alkaline cleaning preparation containing borates, carbonates, phosphates and nonionic surfactants (P3-Almeco TM 18, a product of Henkel KGaA, Duesseldorf, Federal Republic of Germany); bath concentration 5%, by weight, temperature 70° C., immersion time 15 minutes. A mixture (3:1) of NaOH and a pickle containing alkali, alcohols and salts of inorganic acids (P3-Almeco TM 46, a product of Henkel KGaA, Duesseldorf, Federal Republic of Germany) was used for pickling; bath concentration 8% by weight, temperature 55° C., immersion time 10 minutes. Descaling was carried out wih an acidic descaling agent containing salts of inorganic acids and inorganic acids (P3-Almeco TM 90, a product of Henkel KGaA, Duesseldorf, Federal Republic of Germany), bath concentration 15% by weight, temperature 20° C., immersion time 10 minutes. After each process step, the plates were thoroughly rinsed with deionized water.

Subsequent anodizing was carried out by the direct-current/sulfuric acid process; bath composition: 200 g/l $H_2SO_4$, 10 g/l Al; injection of air: 8 $m^3/m^2.h$; temperature: 18° C.; d.c. voltage: 15 V. The anodizing times were about 3 minutes per micron of coating thickness; i.e. the total anodizing times for the oxide coating thicknesses of 15 to 25 microns in the following Examples were 45 to 75 minutes.

After thorough rinsing with deionized water, the plates were subjected to the electrolytic coloring treatment according to the invention (details below). The plates were then rinsed again and subsequently sealed in hot water with the addition of sealing film inhibitor based on salts of organic acids and nonionic surfactants (P3-Almecoseal TM Sl, a product of Henkel KGaA, Duesseldorf, Federal Republic of Germany); bath temperature 98° to 100° C., immersion time 60 minutes, concentration of the sealing film inhibitor 0.2% by weight.

EXAMPLES 1a to 1f

In the following examples, the cationic dyes used were varied along with the thickness of the oxide coatings.

The following cationic dyes were used:

1a: rhodamine 6G as perchlorate (xanthene dye)
1b: crystal violet as chloride (triphenylmethane dye)
1c: malachite green as oxalate (triphenylmethane dye)
1d+e: methyl violet as chloride (triphenylmethane dye)
1f: methylene blue as chloride (azine dye).

The concentration of dye in the aqueous electrolyte was 5 g/l in each case, the temperature of the electrolyte was 20°C and the treatment time (coloring time) was 15 minutes in each case. The pH values of the electrolyte were established by dissolving the dye mentioned in the concentration indicated. Only in the case of Example 1e was a low pH established with $H_2SO_4$.

An a.c. voltage of 15 V (50 Hz)—counter electrode of fine steel—was applied in each case.

The thickness of the oxide coating was measured by the eddy current method according to DIN 50984. After the electrolytic coloring, the particular depth of penetration of the color finish was determined by rubbing off the oxide coating until it began to lighten using an abrasion tester according to ISO/TC 79/SC 2 N420E (International Standards Organization) and subsequent measurement of the remaining coating thickness as above described.

The measured values are shown below in Table 1.

TABLE 1

| Ex. No. | Layer thickness (microns) | Dye | pH | Depth of penetration (microns) | Color |
|---|---|---|---|---|---|
| 1a | 20 | rhodamine 6G | 3.3 | 19 | pink-red |
| 1b | 24 | crystal violet | 4.8 | 22 | blue-violet |
| 1c | 18 | malachite green | 2.3 | 16 | green |
| 1d | 22 | methyl violet | 2.6 | 20 | light violet |
| 1e | 22 | methyl violet | 0.7 | 7 | light violet |
| 1f | 25 | methylene blue | 3.3 | 17 | blue |

The above values show that it is possible to obtain different colorings of the oxide coating combined with high depths of penetration therein, using the inventive process. Example 1e is a comparison which shows that the depth of penetration of the color finish can be influenced or controlled by variation of the pH (compare with 1d). A depth of penetration of less than 8 microns is unacceptable, a depth of at least 12 microns being preferred, and at least 15 microns being more preferred.

EXAMPLES 2a to 2i

The following examples were carried out exclusively with the cationic dye malachite green (as oxalate) with variation of the dye concentration, voltage (a.c.) and coloring time. The following parameters were kept constant in all of the Examples: oxide coating thickness 22 microns; pH of the aqueous electrolyte was 2.3; temperature of the electrolyte 20° C. In Example 2i, a conducting salt (10 g/l $MgSO_4$) was also added to the electrolyte.

The measured values are shown below in Table 2.

TABLE 2

| Ex. No. | Conc. (g/l) | Voltage (V) | Coloring time (mins.) | Depth of penetration (microns) | Color |
|---|---|---|---|---|---|
| 2a | 0.2 | 15 | 30 | 19 | light green |
| 2b | 0.5 | 15 | 25 | 16 | light green |
| 2c | 1 | 15 | 15 | 18 | green |
| 2d | 5 | 15 | 15 | 20 | green |
| 2e | 8 | 15 | 15 | 20 | dark green |
| 2f | 3 | 12 | 20 | 16 | light green |
| 2g | 3 | 22 | 15 | 19 | green |
| 2h | 3 | 25 | 15 | 20 | dark green |
| 2i | 3 | 10 | 20 | 18 | green |

The values obtained in Examples 2a to 2e show that more intensive colors for substantially the same depth of penetration are obtained with increasing concentration of the dye. An increase in the voltage (Examples 2f to 2h) produces the same result. By contrast, the influence of different coloring times is less strongly pronounced.

The addition of the conducting salt in Example 2i (compare with Example 2f, having the same coloring time and concentration) also produces a more intensive color with a slight increase in the depth of penetration, even with a lower voltage.

COMPARISON EXAMPLES 3a to 3d

Test plates which had been pretreated in the same way as for the examples according to the invention were used for the comparison examples. Commercial anionic aluminum dyes were used for coloring the oxide coating. Coloring was carried out on the one hand by the conventional dip process and, on the other hand, using alternating current (15 V, 50 Hz). The temperatures of the aqueous bath or rather the electrolyte were 60° C. in each case and the coloring times 15 minutes. The pH of the baths correspond to those values which were established on dissolution of the particular dye in water.

The dye type and concentration, the thickness of the oxide coating, the color obtained and, in particular, the depth of penetration into the oxide coating, with simple dipping (dip) and with alternating current, (A.C.) are shown below in Table 3.

TABLE 3

(Comparison Examples)

| Ex. No. | Coating thickness (microns) | Dye | Dye con. (g/l) | Depth of penetration (microns) dip | Depth of penetration (microns) A.C. | Color |
|---|---|---|---|---|---|---|
| 3a | 18 | aluminum green MGL | 10 | 6 | 7 | green |
| 3b | 17 | aluminum red RLW | 6 | 6 | 5 | red |
| 3c | 17 | aluminum blue LLW | 3.5 | 4 | 4 | blue |
| 3d | 20 | sanodal blue G | 5 | 4 | 3 | blue |

It can be seen that the depth of penetration of the coloring into the oxide coating was inadequate in every instance. Even the application of alternating current failed to produce any significant increases in the depth of penetration.

We claim:

1. A process for the electrolytic coloring of anodized surfaces of aluminum or aluminum alloy substrates, comprising subjecting to alternating current, with or without superimposed direct current, in electrolytic coloring effective amounts, in the presence of an aqueous electrolyte solution containing a color-imparting effective amount of a cationic dye.

2. The process of claim 1, wherein said dye is selected from the group consisting of triphenylmethane dyes, xanthene dyes, and azine dyes.

3. The process of claim 2 wherein each said dye is in the form of its chloride, oxalate, or perchlorate.

4. The process of claim 3, wherein said dye is selected from the group consisting of crystal violet; malachite green; methyl violet; rhodamine 6G; and methylene blue.

5. The process of claim 4 carried out at about 8 to 30 volts and at about 50 to 60 Hz.

6. The process of claim 4 carried out at about 10 to 22 volts and at about 50 to 60 Hz.

7. The process of claim 6 wherein said organic dye is present in a total amount of about 0.01 to 10 g/l of aqueous electrolyte solution.

8. The process of claim 7 wherein there is also present in the aqueous electrolyte solution a conducting salt selected from the group consisting of water-soluble alkali metal, ammonium, or alkaline earth metal salts of any acid having anions like those of said cationic organic dye.

9. The process of claim 8 wherein there is also present in the aqueous electrolyte solution a conducting salt selected from the group consisting of sodium sulfate and magnesium sulfate, in a concentration of about 5.0 to 20.0 g/l of aqueous electrolyte solution.

10. The process of claim 9 wherein said anodized surfaces are pretreated by subjecting them to direct current in said aqueous solution, during which pretreatment the substrates serve as anodes and the voltage of the direct current is in the same range as for the current of the coloring process.

11. The process of claim 8 wherein said anodized surfaces are pretreated by subjecting them to direct current in said aqueous solution, during which pretreatment the substrates serve as anodes and the voltage of the direct current is in the same range as for the current of the coloring process.

12. A colored anodized surface of aluminum or an aluminum alloy produced by the process of claim 11.

13. A colored anodized surface of aluminum or an aluminum alloy produced by the process of claim 8.

14. The process of claim 1, wherein said dye is selected from the group consisting of crystal violet; malachite green; methyl violet rhodamine 6G; and methylene blue.

15. The process of claim 1, wherein said dye is selected from the group consisting of crystl violet as chloride; malachite green as oxalate; methyl violet as chloride, rhodamine 6G perchlorate; and methylene blue as chloride.

16. The process of claim 1 carried out at about 8 to 30 volts and at about 50 to 60 Hz.

17. The process of claim 1 carried out at about 10 to 22 volts and at about 50 to 60 Hz.

18. The process of claim 1 wherein said organic dye is present in a total amount of from 0.01 g/l of electrolyte solution up to the upper solubility limit of the dye at the temperature of the aqueous electrolyte solution.

19. The process of claim 1 wherein said organic dye is present in a total amount of about 0.01 to 10 g/l of aqueous electrolyte solution.

20. The process of claim 1 wherein said organic dye is present in a total amount of about 0.05 to 5.0 g/l of aqueous electrolyte solution.

21. The process of claim 1 wherein there is also present in the aqueous electrolyte solution a conducting salt in an amount of about 1 to 50 g/l of aqueous electrolyte solution.

22. The process of claim 1 wherein there is also present in the aqueous electrolyte solution a conducting salt selected from the group consisting of water-soluble alkali metal, ammonium, or alkaline earth metal salts of any acid having anions like those of said cationic organic dye.

23. The process of claim 22 wherein said anion is sulfate.

24. The process of claim 1 wherein there is also present in the aqueous electrolyte solution a conducting salt selected from the group consisting of sodium sulfate and magnesium sulfate, in a concentration of about 5.0 to 20.0 g/l of aqueous electrolyte solution.

25. The process of claim 1 wherein said anodized surfaces are pretreated by subjecting them to direct current in said aqueous solution, during which pretreatment the substrates serve as anodes and the voltage of the direct current is in the same range as for the current of the coloring process.

26. The process of claim 1 conducted at a temperature of about 15°–60° C.

27. The process of claim 1 conducted at a temperature of about 15°–25° C.

28. The process of claim 1 wherein the electrolyte solution has an acid to neutral pH.

29. The process of claim 1 wherein the electrolyte solution has a pH of about 2–5.

30. The process of claim 1 conducted for a time of about 10–90 minutes.

31. The process of claim 1 conducted for a time of about 15–30 minutes.

32. A colored anodized surface of aluminum or an aluminum alloy produced by the process of claim 1.

* * * * *